US010010236B2

(12) United States Patent
Alexander

(10) Patent No.: US 10,010,236 B2
(45) **Date of Patent: *Jul. 3, 2018**

(54) HOUSEHOLD APPLIANCE AND METHOD OF OPENING THE SAME

(71) Applicant: WHIRLPOOL CORPORATION, Benton Harbor, MI (US)

(72) Inventor: Benjamin E. Alexander, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/634,426

(22) Filed: Jun. 27, 2017

(65) Prior Publication Data

US 2017/0290488 A1 Oct. 12, 2017

Related U.S. Application Data

(60) Continuation of application No. 15/287,104, filed on Oct. 6, 2016, now Pat. No. 9,723,967, which is a (Continued)

(51) Int. Cl.
*A47L 15/00* (2006.01)
*A47L 15/42* (2006.01)
(Continued)

(52) U.S. Cl.
CPC ..... *A47L 15/4257* (2013.01); *A47L 15/22* (2013.01); *A47L 15/4225* (2013.01); *A47L 15/4261* (2013.01); *A47L 15/4265* (2013.01); *A47L 15/4285* (2013.01); *A47L 15/4293* (2013.01); *A47L 15/502* (2013.01); *A47L 15/507* (2013.01); *E05F 15/73* (2015.01); *A47L 2401/20* (2013.01); *A47L 2401/22* (2013.01); *A47L 2401/26* (2013.01); *A47L 2401/30* (2013.01); *A47L 2401/32* (2013.01); (Continued)

(58) Field of Classification Search
CPC ..... A47L 15/4257; A47L 2401/32; A47L 2401/34; A47L 2501/22; A47L 2501/126
USPC ..... 312/228, 352, 326, 327, 328, 329
See application file for complete search history.

(56) References Cited

U.S. PATENT DOCUMENTS 4,894,952 A 1/1990 Trett et al.
6,783,167 B2 8/2004 Bingle et al.
(Continued)

FOREIGN PATENT DOCUMENTS

DE 102009003120 A1 11/2010
DE 102009026659 A1 12/2010
(Continued)

OTHER PUBLICATIONS

German Search Report; dated October 15, 2015; Ruschke Madgwick Seide & Kollegen.

*Primary Examiner* — Daniel J Rohrhoff
(74) *Attorney, Agent, or Firm* — McGarry Bair PC

(57) ABSTRACT

A method of opening a door of a household appliance having a cabinet with an open face providing access to a treating chamber where an article is received for treatment according to a useful cycle of operation is provided. The method includes: sensing a presence of at least a portion of a person, visually indicating and automatically opening the door in response to the sensed presence.

20 Claims, 5 Drawing Sheets

Related U.S. Application Data division of application No. 14/102,743, filed on Dec. 11, 2013, now Pat. No. 9,474,432.

(51) Int. Cl.
*A47L 15/22* (2006.01)
*A47L 15/50* (2006.01)
*E05F 15/73* (2015.01)

(52) U.S. Cl.
CPC ..... *A47L 2401/34* (2013.01); *A47L 2501/22* (2013.01); *A47L 2501/26* (2013.01); *E05F 2015/765* (2015.01); *E05Y 2400/44* (2013.01); *E05Y 2400/45* (2013.01); *E05Y 2900/304* (2013.01)

(56) References Cited

U.S. PATENT DOCUMENTS 7,594,513 B2 9/2009 Vanderroest et al.
7,741,801 B2 6/2010 Fukuizumi
7,781,995 B2 8/2010 Yang et al.
8,888,045 B2 * 11/2014 Boren ..... E05F 15/00 244/118.5
9,474,432 B2 * 10/2016 Alexander ..... A47L 15/4257
9,723,967 B2 * 8/2017 Alexander ..... A47L 15/4257
2008/0210274 A1 9/2008 Vanderroest et al.
2008/0276976 A1 11/2008 Buller et al.
2009/0300988 A1 12/2009 Bem
2010/0287837 A1 11/2010 Wuerstlein et al.
2011/0036383 A1 2/2011 Tiekoetter et al.
2012/0055091 A1 * 3/2012 Backherms ..... A47L 15/4259 49/31
2013/0119838 A1 * 5/2013 Becker ..... F24C 15/02 312/236
2013/0145692 A1 * 6/2013 Laird ..... E05F 15/73 49/31
2013/0234828 A1 * 9/2013 Holzberg ..... B60R 25/2054 340/5.72
2013/0291439 A1 11/2013 Wuerstlein et al.
2014/0069015 A1 * 3/2014 Salter ..... E05B 81/76 49/31
2014/0265805 A1 9/2014 Chamberlin
2015/0019017 A1 * 1/2015 Bodine ..... D06F 39/14 700/275
2015/0157184 A1 6/2015 Alexander

FOREIGN PATENT DOCUMENTS

DE 102010037397 A1 3/2012
DE 102011050538 A1 11/2012
EP 1935313 B1 10/2009
WO 2011039362 A1 4/2011

* cited by examiner

HOUSEHOLD APPLIANCE AND METHOD OF OPENING THE SAME

CROSS-REFERENCE TO RELATED APPLICATIONS

This application is a continuation of U.S. application Ser. No. 15/287,104, filed Oct. 6, 2016, now U.S. Pat. No. 9,723,967, which is a divisional of U.S. application Ser. No. 14/102,743, filed Dec. 11, 2013, now U.S. Pat. No. 9,474,432, both of which are incorporated herein by reference in their entirety.

BACKGROUND

For design reasons, contemporary kitchens often include cabinets and household appliances without externally visible handles. In the case of a fully integrated household appliance, a completely paneled door may blend in with the other kitchen elements. Many household appliances have a door that must be opened to access an internal chamber prior to or sometime after performing a cycle of operation. Contemporary appliances often include visible feedback relating the status of the appliance or a cycle of operation to a user of the appliance.

BRIEF DESCRIPTION

One aspect of the present disclosure relates to a household appliance including a cabinet defining a treating chamber with an open face, a door moveably mounted to the cabinet for movement between opened and closed conditions to selectively close the open face, a door opening mechanism for automatically opening the door, and a proximity sensor configured to sense a presence of at least a portion of a person within a predetermined range of the door and out of contact with the door when the door is in the closed condition.

DETAILED DESCRIPTION

While exemplified in a dishwasher, the description below is equally applicable to any household appliance having a door for accessing an interior treating chamber where the treating chamber can receive one or more article(s) and the appliance may treat the article(s) according to a useful cycle of operation. That is, the household appliance may be any domestic appliance that performs a particular job in a home, including those relating to cleaning, cooking, or food preservation. Non-limiting examples of household appliances include a refrigerator, a clothes washing machine, a clothes dryer, a freezer, a range, a kitchen stove, an oven, a cooker, and a microwave.

Figure 1:
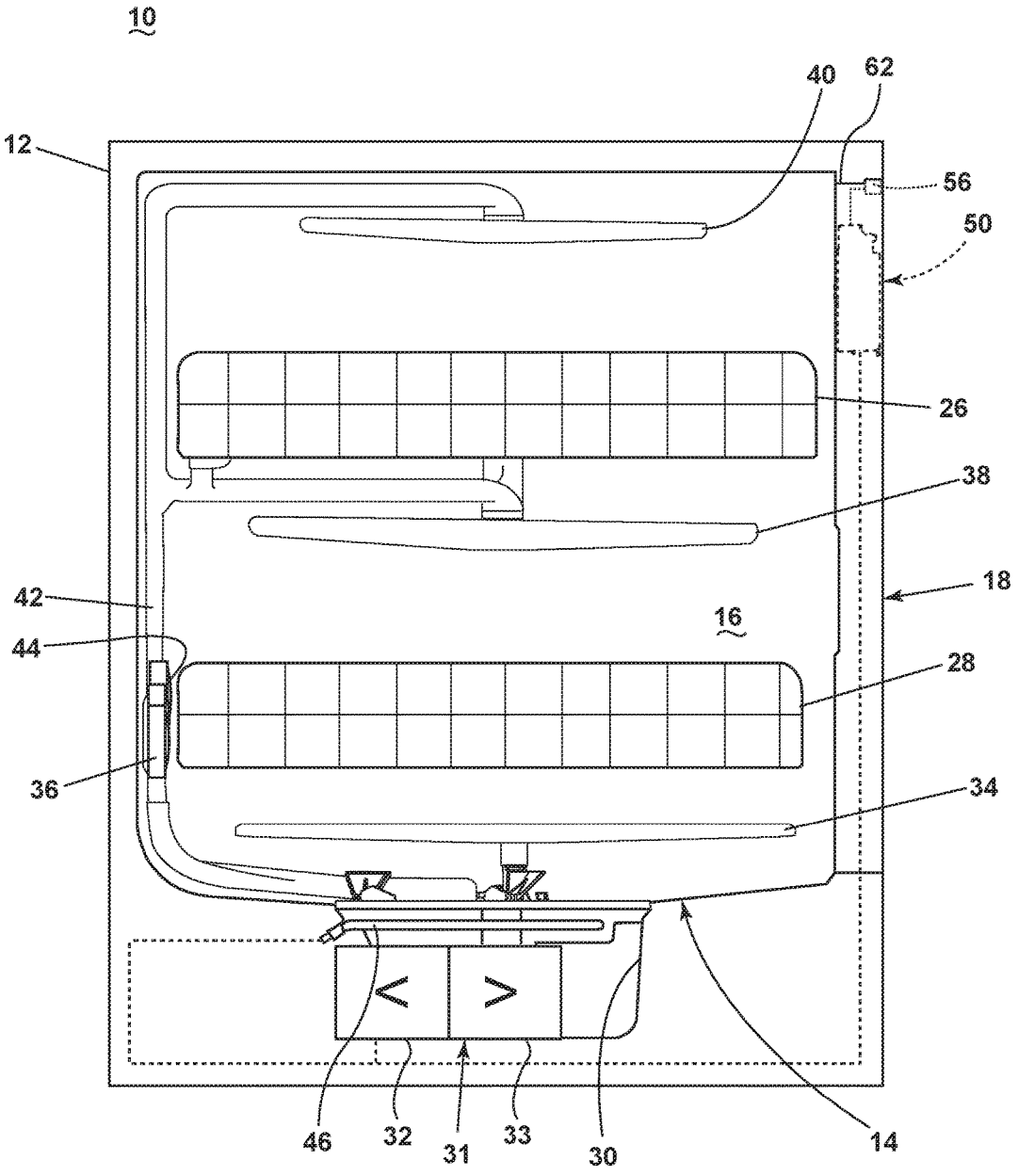
FIG. 1 is a schematic, cross-sectional view of a dishwasher according to an embodiment.

In FIG. 1, an automated dishwasher 10 according to an embodiment is illustrated. The dishwasher 10 shares many features of a conventional automated dishwasher, which will not be described in detail herein except as necessary for a complete understanding of the invention. A cabinet 12 may define an interior of the dishwasher 10 and may include a frame, with or without panels mounted to the frame. An open-faced tub 14 may be provided within the cabinet 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the cabinet 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the treating chamber 16 and is illustrated in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the cabinet 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information. The user interface 56 may include elements that may be provided along the top edge 62 and/or on the external surface of the door assembly 18. Thus, the user interface 56 may be one or more elements, which may be centralized or dispersed relative to each other. For example, input and display element may be centralized while corresponding sensor elements may be spaced related to the centralized input and display elements.

Figure 2:
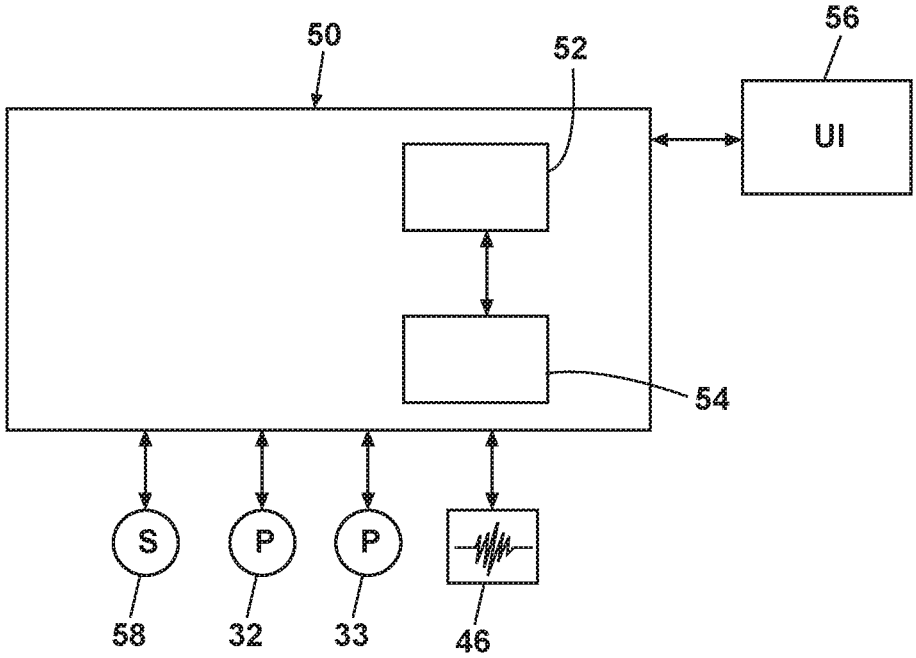
FIG. 2 is a schematic view of a controller of the dishwasher of FIG. 1.

As illustrated schematically in FIG. 2, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber. Additional sensors, as discussed in more detail below, may include proximity sensors for determining the presence of a consumer in proximity to the door 18.

Figure 3:
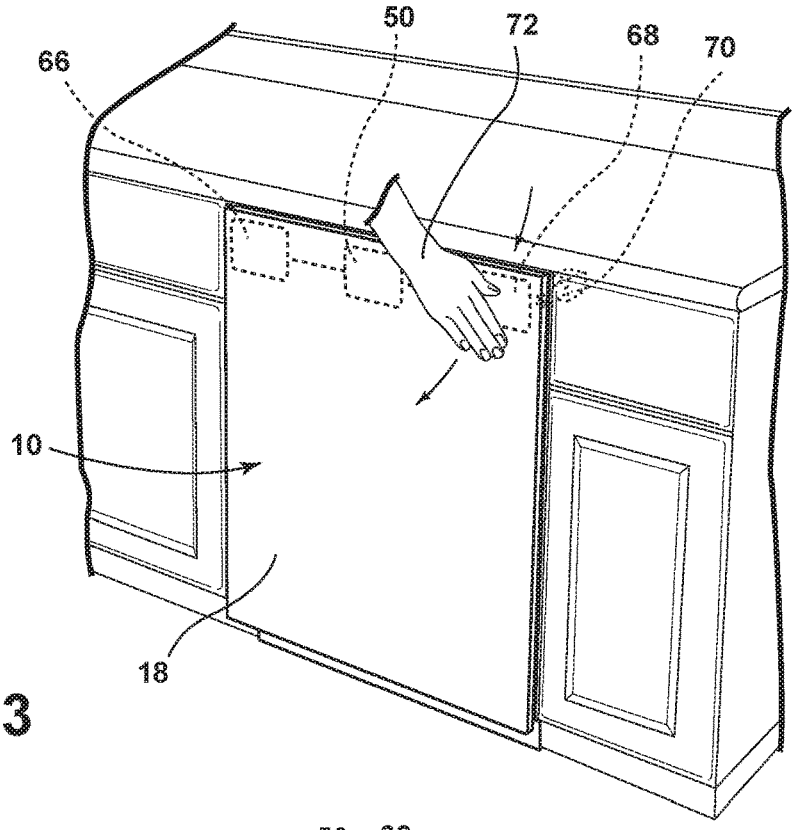
FIG. 3 is a perspective view of a consumer's hand initiating a contact-free method of opening a dishwasher having a door with a smooth uninterrupted outer surface according to an embodiment.

FIG. 3 illustrates a proximity sensor 68 provided relative to a portion of the door 18 and configured to sense the presence of at least a portion of the consumer, exemplified herein as the consumer's hand 72 though any portion of the consumer may be sensed. The proximity sensor may be used as input to the controller 50 to initiate a contact-free method of opening a dishwasher 10 having a door 18. Preferably, to permit better locating of the consumer hand with the door, the door has a smooth, uninterrupted, outer surface according to an embodiment. However, a smooth, uninterrupted surface is not required. The smooth, uninterrupted surface may also include the absence of the traditional handle, which is normally located near the top of the door. Such a handle, depending on its location, might interfere with the operation of the sensor. The absence of the handle will also improve the aesthetic of the door and improve the ease of cleaning of the door.

The proximity sensor 68 may be located anywhere on the front of face of the door 18 of the dishwasher 10, but may preferably be located so that a consumer may readily identify the sensing location. As shown, the proximity sensor 66, 68 may be located at either of the top corners of the door 18.

When the consumer's hand 72 is placed within a predetermined range and out of contact with the door 18, the proximity sensor 68 may signal the controller 50. The controller 50 may determine, based on the output signal of the proximity sensor 68, to send a signal to a door-opening mechanism 70 that may include an actuator and a spring mechanism to release the door 18 from the closed position.

Figure 4:
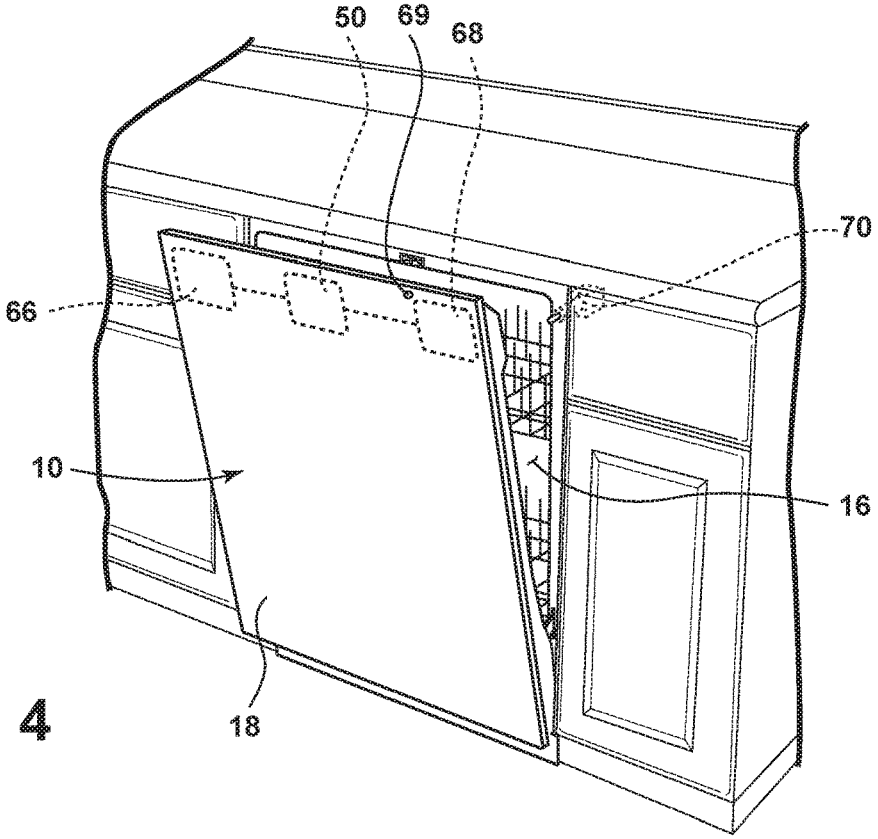
FIG. 4 shows a perspective view of the dishwasher in FIG. 3 with the door in an open position.

Consequently, as shown in FIG. 4, the door-opening mechanism 70 opens the door 18 to a degree that the consumer may open it completely to access the treating chamber 16 without requiring a handle on the front face of the door 18 of the dishwasher 10. It is also contemplated that the door could be fully automatically opened. However, in most cases a "popping" open of the door (door is slightly ajar) a sufficient amount for the user to grasp an upper portion of the door is sufficient. It is also possible to include a recess or handle in an upper edge of the door, which would be accessible after the door is popped open to aid in the full opening of the door.

In addition to sensing the presence of the consumer at a predetermined range, the controller 50 may require persistent sensing for a predetermined time before signaling the release of the door 18. Preferably, the predetermined time duration may be one second though other durations are contemplated. Other durations may range from a quarter of a second to five seconds.

To provide feedback to a consumer, a light source, shown as an LED 69, provided on the door 18 may visually indicate the sensing of the presence within the predetermined range of the door 18. For example, the LED 69 may blink slowly, or "beat", a number of times (e.g., three) to indicate that the proximity sensor 68 is detecting the presence of the consumer.

Figure 5:
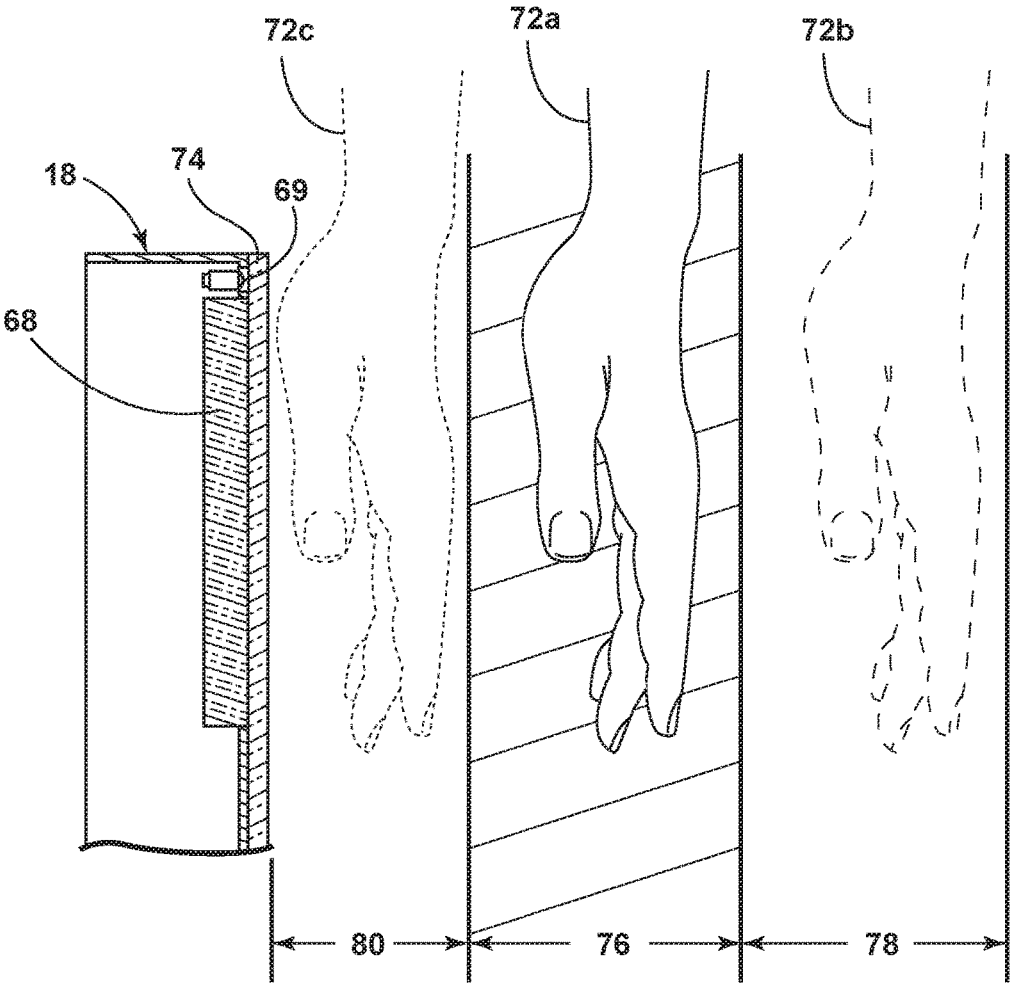
FIG. 5 shows a cross section of a portion of a door of a dishwasher with a user's hand in various proximity to the surface of the door according to an embodiment.

As shown in FIGS. 3 and 4, the door 18 of the appliance may include a smooth, uninterrupted outer surface that provides a desirable aesthetic. For example, as shown in FIG. 5 the external surface 74 of the door 18 may be formed as one continuous, unadulterated piece of black glass. To further the aesthetic, the LED 69 may be provided behind the external surface 74 and is not visible to the consumer when not illuminated. The same LED 69 used to indicate that the proximity sensor 68 is detecting the presence of the consumer's hand 72 may also be used to indicate the status of a cycle of operation. For instance, if the LED 69 is "beating" steadily without the proximity sensor 68 sensing a presence, the LED lighting pattern may indicate that a cycle of operation is currently active. Additionally or alternatively when the LED 69 is steadily illuminating, it may indicate that a cycle of operation is complete. While the light source has been described as a single LED 69, multiple LEDs may be implemented. For example, a series of LEDs that blink in one of a set of predetermined sequences may provide many different visual patterns. By integrating multiple LEDs, more light patterns may provide a more intuitive means of communication with the consumer. Regardless of the number or arrangement of LEDs implemented as a light source, it is contemplated that when not illuminating, none of the LEDs are visible to the consumer.

As shown in FIG. 5, the proximity sensor 60 may be sensitive to both the presence of the consumer's hand 72*a* as well as the specific distance from the proximity sensor 68. Preferably, the proximity sensor 68 may signal the detection of a presence in an optimal region 76, where the optimal region 76 includes the set of distances from the proximity sensor 68 bound by a minimum and maximum distance. Preferably, the optimal region 76 may include the set of distances ranging from one-half to two inches away from the surface 74 of the door in front of the proximity sensor 68. In this way, a consumer's hand 72*b* positioned in a region 78 that is too far away from the proximity sensor 68 will not trigger the release of the door 18 from a closed position. Similarly, a consumer's hand 72*c* that is placed directly on the surface 74 of the door 18 or in a region 80 very near the surface 74 of the door will not trigger the release of the door 18. By requiring the sensed presence to occupy an optimal region 76, false triggering caused by the presence of a consumer (or a child or pet) standing nearby the appliance may be minimized.

Figure 6:
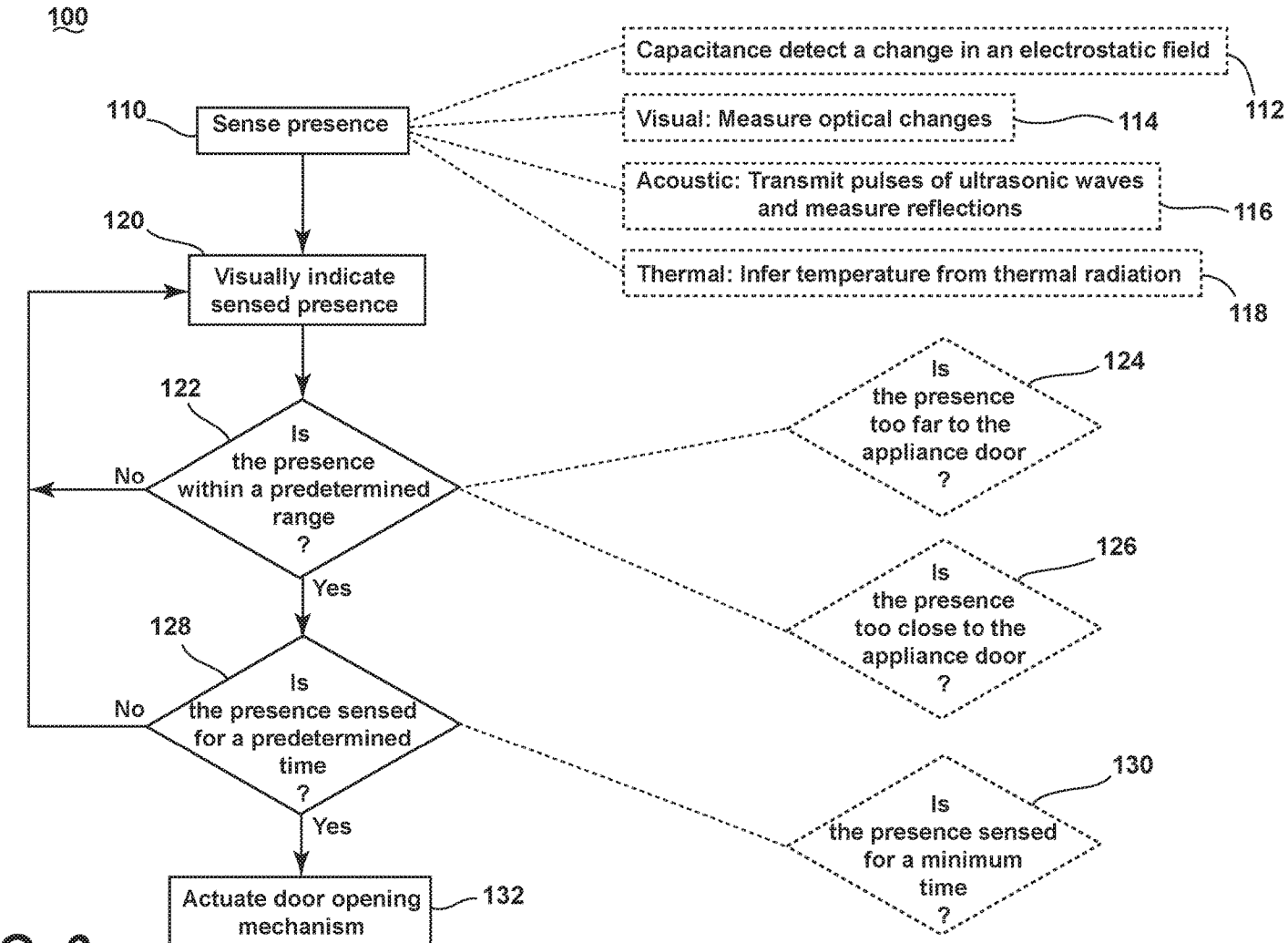
FIG. 6 is a flow chart depicting a method of opening a household appliance according to an embodiment.

Referring now to FIG. 6, an out of contact method 100 for initiating the opening of a door of a household appliance according to an embodiment may include one or more sensing modalities described herein. Initially at step 110, a proximity sensor 68 may sense a presence; that is, the sensor may detect the presence of nearby objects without any physical contact. Sensing objects at a distance typically involves either one or both of probing the nearby environment and exploiting the physical characteristics of a target object. While a number of different types of proximity sensors may be implemented, proximity sensors typically operate by detecting changes in an electromagnetic or acoustic field or beam of radiation. The sensor may be active, that is, the proximity sensor may emit electromagnetic radiation or sound to detect changes in the nearby environment. Alternatively, the sensor may be passive, whereby the sensor monitors and detects changes in an electromagnetic or acoustic field or beam of radiation without substantially contributing to the field or radiation.

As an example of a proximity sensing modality, in step 112, a capacitive proximity sensor senses a presence by detecting a change in an electrostatic field. A capacitive proximity sensor detects the presence of conductive objects or objects with a dielectric different from that of air. Typically, a capacitive proximity sensor establishes an electromagnetic field that is responsive to nearby conductive objects. For example, the sensor may detect a change in frequency of the established electromagnetic field that corresponds to a conductive object entering or leaving the field.

As another example of a proximity sensing modality, in step 114, a visual (or optical) proximity sensor senses a presence by measuring changes in the visible (or near infrared or ultraviolet) region of the electromagnetic spectrum. The optical proximity sensor typically includes an integrated circuit with a window overtop a photo detector (e.g. a charge-coupled device or CCD). The relative placement of the optical elements of the sensor may determine the observable field of view of the optical element as is well known in the field of optical design. By configuring multiple photo detecting elements (e.g. CCDs) with partially overlapping, non-parallel fields of view, an optical proximity sensor may be configured to sense a presence at certain positions or standoff. Optical sensing devices are often combined with infrared lights or optical filters to minimize false detections caused by external light sources. Other optical proximity sensors include laser range finders that actively transmit pulses of light and measure the time required to detect the return pulse whereby a distance is determined by calculating the time interval between the transmitted and received pulses.

As another example of a proximity sensing modality, in step 116, an acoustic proximity sensor senses a presence by transmitting pulses of ultrasonic waves and measuring the reflections. Ultrasonic sensors (typically embodied as transducers) work on a principle similar a laser range finder's measurement of range to a target by comparison of transmitted and reflected pulses. Ultrasonic sensors generate high frequency acoustic waves and evaluate the echo that is received and measured by the sensor to determine the distance to an object.

Similarly, radar actively transmits electromagnetic waves in predetermined directions that are reflected and scattered when they contact an object. The radar measures the reflected pulses to determine the range to an object (again, by the calculated time interval between the transmission and reception of the pulse) and other target characteristics based upon the characteristics of the returned pulse.

Another example of a proximity sensing modality, in step 118, includes non-contact thermal detection that is based on inferences of temperature made from measurements of thermal radiation. Passive infrared sensors detect the proximity of humans and animals by detecting a change in infrared thermal heat patterns in the field of view of the sensor. The thermal proximity sensor implements a pair of pyroelectric elements that generate signals that correlate to changes in temperature. Differences in the signal output of the two pyroelectric elements indicate movement by a heat-bearing object, such as a human. Similar to the optical sensor described above, the arrangement of multiple passive infrared sensing elements may limit false triggering. Additionally, temperature information may limit false alarms. For example, the average consumer's temperature is likely to be different from the consumer's pet dog.

To increase the overall effectiveness of the proximity sensing, a hybrid proximity sensor is contemplated that combines features of two or more of the proximity sensing modalities described above. Additional types of proximity sensing that may be integrated into the hybrid proximity sensor include, but are not limited to, Doppler effect sensing, eddy-current sensing, inductive sensing and magnetic sensing.

Upon sensing a presence, the controller 50 in communication with the proximity sensor 68 may signal the light source (e.g. LED 69) to visually indicate the sensed presence at step 120. As described above, the light source may actively emit light or a pattern of beating lights when a presence is sensed.

The controller 50 may step through additional logic to determine if the door-opening mechanism 70 should be actuated to automatically open the door 18. At step 122, the controller 50 may determine if the sensed presence is detected within a predetermined range. The determination may further include determining if the sensed presence is too far away from the door 18 at step 124 or if the sensed presence is too close to the door 18 at step 126. Included in the determination that the sensed presence is too close to the door 18 is the determination that the presence is in physical contact with the door 18.

If the controller 50 determines that the sensed presence is within the predetermined range, the controller 50, at step 128, may determine if the presence is sensed for a predetermined duration of time. The determination may further include the step 130 of determining if the sensed presence has been sensed for a minimum time.

If the controller 50 determines that the sensed presence is within the predetermined range at step 122 for the predetermined time at step 128, then the controller 50 at step 132 may signal the actuation of the door-opening mechanism 70. The door 18 may then be released, moving from the closed position to an open position.

As described above, the door of a household appliance may be selectively opened by a consumer who is out of contact with the door or any aspect of the household appliance. The embodiments described enable hands-free access to the treating chamber of the appliance. Furthermore, the configuration of proximity sensors described above, in concert with the control logic for exploiting the proximity sensor outputs, enable a robust opening procedure that may mitigate false or undesirable triggering of the door-opening mechanism.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A household appliance, comprising:

a cabinet defining a treating chamber with an open face;

a door moveably mounted to the cabinet for movement between an opened condition and a closed condition to selectively close the open face and where the door is without an externally visible handle;

a door opening mechanism for automatically releasing the door; and a proximity sensor configured to sense a presence of at least a portion of a person adjacent the door, within a predetermined range of the door, and out of contact with the door when the door is in the closed condition;

wherein when the proximity sensor senses the presence, the door opening mechanism releases the door from the closed condition such that the door is ajar.

2. The household appliance of claim 1 wherein the door is handle-less.

3. The household appliance of claim 1 wherein the door includes a recess or handle that is accessible only when the door is ajar.

4. The household appliance of claim 1, further comprising a controller operably coupled to the door opening mechanism and the proximity sensor and adapted to receive an input from the proximity sensor and actuate the door opening mechanism to automatically open the door.

5. The household appliance of claim 4, further comprising a visual indicator operably coupled to the controller and configured to provide an indication of the proximity sensor sensing the presence.

6. The household appliance of claim 5 wherein the visual indicator is a light source.

7. The household appliance of claim 6 wherein the light source is further adapted to indicate a status of a cycle of operation of the household appliance.

8. The household appliance of claim 1 wherein the proximity sensor is at least one of a capacitive proximity sensor, an optical proximity sensor, a laser range finder, an ultrasonic sensor, a radar and a non-contact infrared thermometer.

9. A household appliance comprising:

a cabinet defining a treating chamber with an open face;

a door moveably mounted to the cabinet for movement between an opened condition and a closed condition to selectively close the open face and where the door is without an externally visible handle;

a door opening mechanism for automatically releasing the door;

a proximity sensor configured to sense a presence of at least a portion of a person adjacent the door, within a predetermined range of the door, and out of contact with the door when the door is in the closed condition; and a visual indicator configured to provide an indication of the proximity sensor sensing the presence;

wherein when the proximity sensor senses the presence, the door opening mechanism releases the door from the closed condition such that the door is ajar.

10. The household appliance of claim 9 wherein the door is handle-less.

11. The household appliance of claim 9 wherein the door includes a recess or handle that is accessible only when the door is ajar.

12. The household appliance of claim 9, further comprising a controller operably coupled to the door opening mechanism, the proximity sensor, and the visual indicator and adapted to receive an input from the proximity sensor, provide an indication via the visual indicator, and actuate the door opening mechanism to automatically open the door.

13. The household appliance of claim 12 wherein the visual indicator is further adapted to indicate a status of a cycle of operation of the household appliance.

14. A method of opening a door of a household appliance having a cabinet with an open face providing access to a treating chamber where an article is received for treatment according to a useful cycle of operation, the method comprising:

sensing a presence of at least a portion of a person adjacent the household appliance, within a predetermined range of the household appliance, and out of contact with the household appliance and wherein the door is without an externally visible handle when the door is in a closed position; and releasing the door from the closed position in response to the sensed presence such that the door is ajar.

15. The method of claim 14 wherein the releasing the door comprises popping open the door via a spring mechanism.

16. The method of claim 14 wherein releasing the door provides user access to a recess or handle in an upper edge of the door.

17. The method of claim 14, further comprising visually indicating the sensing of the presence within the predetermined range.

18. The method of claim 17 wherein the sensing the presence comprises sensing the presence for a predetermined time.

19. The method of claim 18 wherein sensing the presence for a predetermined time comprises determining a persistent sensing for the predetermined time.

20. The method of claim 14 wherein the sensing the presence comprises sensing at least one of a capacitance, visual presence, acoustic reflection, and temperature within the predetermined range.

* * * * *